US006027807A

United States Patent [19]

Inoue et al.

[11] Patent Number: 6,027,807

[45] Date of Patent: Feb. 22, 2000

[54] GRAPHITE CLADDING LAMINATE STRUCTURAL MATERIAL AND A GRAPHITE DEVICE HAVING SAID MATERIAL

[75] Inventors: Takao Inoue, Hirakata; Junji Ikeda, Ikoma; Yasuyuki Watanabe, Hirakata; Noboru Izutani, Sakai; Kazuhiro Mori, Katano; Naomi Nishiki, Kyoto; Daido Komyoji, Ikoma; Katsuhiko Yamamoto, Nabari, all of Japan

[73] Assignee: Matsushita Electric Industrial Co., Ltd., Japan

[21] Appl. No.: 08/584,328

[22] Filed: Jan. 11, 1996

[30] Foreign Application Priority Data

Jan. 11, 1995 [JP] Japan ..... 7-002573
Jan. 26, 1995 [JP] Japan ..... 7-010585

[51] Int. Cl.[7] ..... B32B 9/00

[52] U.S. Cl. ..... 428/408; 423/448; 297/180.12; 5/636; 36/26

[58] Field of Search ..... 428/408; 423/448; 297/180.12; 5/636; 36/2.6

[56] References Cited

FOREIGN PATENT DOCUMENTS 1-51442 12/1986 Japan .
3-75211 3/1991 Japan .
4-21508 1/1992 Japan .

*Primary Examiner*—Timothy Speer
*Attorney, Agent, or Firm*—Wenderoth, Lind & Ponack, L.L.P.

[57] ABSTRACT

It is a object of this invention to provide a graphite cladding sheet having an excellent mechanical strength and applicable to wide use and a graphite device using said sheet. The graphite cladding sheet 10 comprises a flexible thin graphite sheet having a high orientation and a supporting sheet 12 fixedly laminated on one surface of the graphite film 11. If necessary, the graphite film may be sandwiched between the supporting sheet and the interlocking element by binding them with an adhesive filled in the hole which pass through the graphite film.

16 Claims, 17 Drawing Sheets

GRAPHITE CLADDING LAMINATE STRUCTURAL MATERIAL AND A GRAPHITE DEVICE HAVING SAID MATERIAL

The invention relates to a graphite cladding laminate structural material which comprises a flexible graphite sheet made by baking a polymer film which has a good heat conductive characteristics in a surface extending direction of the graphite sheet due to the graphite crystalline orientation in the same direction, and a device having said material.

BACKGROUND OF THE INVENTION

Graphite holds an important position as an industrial material which has useful properties such as an excellent heat resistance, chemical resistance, high electric conductivity and so on, and has been used widely as materials for a secondary battery electrode, exothermic body, gasket, heat resistant seal and so on and a structural material.

Particularly, as for a graphite sheet obtained by heating a film of a given polymeric compound at and above 2400° C. in the inert gas and, if necessary, rolling the resulting film, it is found that an uniform foaming state is made by heating at a high temperature and a graphite sheet having flexibility and elasticity is obtained by rolling. Moreover, this graphite sheet has a crystalline orientation in an surface extending direction of the graphite sheet (i.e. has a high orientation). Thus, a light material having a good heat resistance of which heat conductivity can not easily be affected by the thickness of the sheet can be provided (see Japanese Patent Laid-Open Publication No. Hei 3-75211 and 4-21508).

However, when the conventional flexible graphite is used for above-mentioned application, mechanical strength is sometimes insufficient due to its flexibility. On the other hand, a graphite sheet having a high orientation described in Japanese Patent Publication No. Hei 1-51442 is obtained by pressurizing and baking a film of a given polymeric compound and has good mechanical strength. However, since this graphite sheet does not have flexibility, a graphite element having an arbitrary shape can not be obtained, the application range is limited, and such a graphite sheet cannot be used in a wide range of applications.

SUMMARY OF THE INVENTION

Thus, it is an object of the invention to provide a graphite cladding laminate structural material which has good mechanical strength and can be used for a wide range of applications.

It is another object of the invention to provide a device having said graphite cladding laminate structural material.

According to the present invention, there is provided a graphite cladding laminate structural material which comprises a flexible graphite sheet made by baking a polymer film which has a good heat conductive characteristics in a surface extending direction of the graphite sheet due to the graphite crystalline orientation in the same direction, and particularly which has Rocking characteristics of less than 20 degrees, and a supporting element or elements which are fixedly laminated on at least one surface of the graphite sheet.

According to the present invention, there is provided a graphite cladding laminate structural material which comprises either graphite sheet or sheets which are fixedly laminated on one or both surfaces of the supporting element, or supporting elements which are fixedly laminated on both surfaces of the graphite sheet.

As a given polymeric compound, at least one can be used which is selected from the group consisting of various kinds of polyoxadiazoles, polybenzothiazole, polybenzobisthiazole, polybenzoxazole, polybenzobisoxazole, various kinds of polyimides, various kinds of polyamides, polyphenylenebenzoimidazole, polythiazole, polyparaphenylenevinylene.

Examples of said polyoxadiazole may include polyparaphenylene-1,3,4-oxadiazole and its isomers.

Examples of said polyimide may include an aromatic polyimide represented by the following general formula (I).

[Chemical formula 1]

(I)

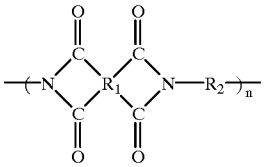

[Chemical formula 2]

Wherein $R_1$ =

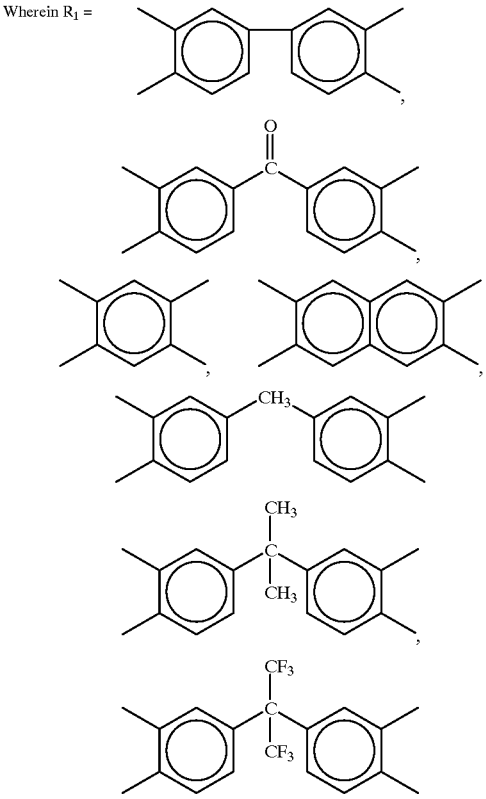

[Chemical formula 3]

$R_2$ =

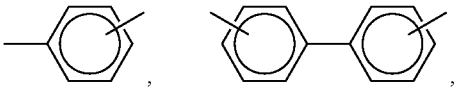

-continued

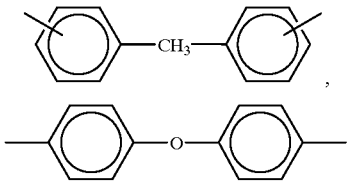

Examples of said polyamide may include an aromatic polyamide represented by the following general formula (II).

[Chemical formula 4]

(II)

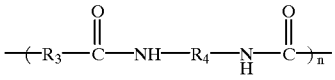

Wherein $R_3$ = 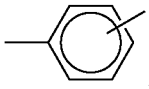 , $R_4$ = 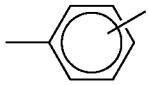

It is preferable to graphitize a polymer film by heating at and above 2400° C., preferably around 3000° C. Thus, a graphite sheet can be obtained which has a higher orientation. By the way, when the baking is performed under the conditions that the highest temperature is below 2000° C., the resulting graphite tends to be hard and brittle.

The heat treatment is usually performed in the inert gas. The pressure during the baking may be atmospheric pressure. After the heat treatment, if necessary, the rolling process may be performed.

When the heat treatment is conducted, the thickness of the polymer film is preferably in the range of 5 to 200 $\mu$m in order to prevent the influence of the gas which emerges during the graphitization process. If the thickness of the film as a raw material exceeds 200 microns, the film crumbled due to the gas emerging from the inside of the film during the heat treatment, and therefore, it is difficult to use such film solely as a good material.

An organic filler is preferably added to said polymer film. The filler functions to make the film treated by heating in an uniformly foamed state. That is, the added filler generates gas during the heat treatment, resulting in a hollow. The hollow makes a way for the discomposed gas to pass from inside of the film. Thus, the filler is useful to make an uniformly foamed state.

The content of the filler such as titanium oxide or sodium hydrogen phosphate is preferably 0.2 to 20% by weight, if necessary, with phosphoric ester, more preferably 1 to 10% by weight. The optimal content of the filler depends on the thickness of the polymer film. When the thickness of the film is small, a large amount of the filler may be added. On the other hand, when the thickness is large, a small amount may be added.

Examples of the filler used for this purpose may include compounds based on phosphoric ester, calcium phosphate, polyester, epoxy, stearic acid, trimellitic acid, metal oxide, organic tin and lead, azo compounds, nitroso compounds and compounds based on sulfonylhydrazide.

Particularly, a polymeric film having a thickness of 5 to 200 $\mu$m is formed by using an aromatic imide represented by above-mentioned general formula wherein R1 is an aromatic carbohydride as a polymeric compound and 0.2 to 20% by weight, preferably 1 to 10% by weight, of titanium oxide or calcium hydrogen phosphate, if necessary, with phosphoric ester, as said filler. When the film is heated under above-mentioned conditions, the resulting flexible graphite sheet demonstrates Rocking characteristics of less than 20 degrees, a specific gravity of 0.5 to 1.5, heat conductivity in the direction of the surface AB of 860 kcal/mh°C. (which is 2.5 times compared to Cu, 4.4 times Al), electric conductivity in the direction of the surface AB of 250,000S/cm and an elasticity in the direction of the surface AB of 84,300 kgf/mm2. The Rocking characteristic in this document means the Rocking characteristic measured at the peak position of graphite(0002) using a ROTAFLEX RU-200B type of X-ray diffractometer manufactured by RIGAKU Electric Co., ltd.

The resulting graphite sheet has a cleaving property and therefore, it has an insufficient mechanical strength and moldability to use alone. Thus, a supporting element is used to reinforce the graphite cladding laminate structural material. If the graphite cladding laminate structural material according to the present invention is used for a heat-exchanger, the supporting element is preferably a metal sheet and may be metal lathe plate having recesses and projections or a metal plate having through hole provided with surrounding projection.

If the graphite cladding laminate structural material according to the present invention is used for another application, said supporting element may be made of the material selected from the group consisting of ceramics, resins, clothes and papers.

According to the present invention, the graphite cladding laminate structural material may be manufacturing by making through holes in the adhered parts of the graphite sheet before baking said polymer film or after forming the graphite sheet, filling the adhesive in said through holes and putting said graphite sheet between the supporting element and interlocking elements having a given area positioned at a surface opposite to said supporting element, in order to laminate the supporting element more fixedly on the graphite sheet.

The adhesive should be selected depending on the material of the supporting element and in the case of a metallic supporting element, a conductive paste may be selected, so as to not disturb the heat conductivity in an surface extending direction of the graphite sheet.

According to the present invention, there is provided a graphite cladding laminate structural material which comprises a flexible graphite sheet having a high orientation and a supporting element or elements fixedly laminated on at least one surface of the graphite sheet, with the result that the supporting element or elements provide a mechanical strength and the flexible graphite sheet allows the material to have an arbitrary shape fitting that of the supporting element. Therefore, a graphite cladding laminate structural material can be provided which has a good mechanical strength and can be used in many ways.

Particularly, in the case that the flexible graphite sheet has a Rocking characteristic of less than 20 degrees, the orientation of the crystal becomes higher and the heat conductivity is enhanced.

In the case that the supporting element is made of metal, for example, when a magnetic shielding metal such as iron is used, a magnetic shielding effect can be obtained. When a metal having good heat conductivity such as copper and aluminum is used, the heat can be conducted efficiently in the direction parallel to the orientation and such a graphite cladding laminate structural material can be used widely for heat radiation from the heating unit and cooling thereof etc.

In the case that the supporting element is a metal lathe plate having recesses and projections, the supporting element can be easily fixedly laminated on the graphite sheet by engaging the projections of the interlocking element in the graphite sheet. And the grid of the metal lathe plate can break off the graphite sheet in the orientating direction, with the result that the heat conductivity can be changed in the thickness direction of the graphite sheet. Moreover, the metal lathe plate in which the recesses engage can function as an anchor to laminate fixedly on the graphite sheet various kinds of elements which is difficult to be fixed on the graphite sheet.

In the case that the supporting element is a metal plate having through holes, the supporting element can be easily fixedly laminated on the graphite sheet by engaging the projections surrounding the through holes of the interlocking element in the graphite sheet. And the projections surrounding the through holes of metal plate can break off the graphite sheet in the orientating direction, with the result that the heat conductivity can be changed in the thickness direction of the graphite sheet. Moreover, the metal plate having through holes can function as an anchor to laminate fixedly on the graphite sheet various kinds of elements which is difficult to be fixed on the graphite sheet. Besides, the through holes of the metal plate can be used for through holes of the circuit board and so on.

In the case that the supporting element is a ceramic sheet, the heat conductivity can be changed in the thickness direction of the graphite sheet by means of the interlocking element and the graphite sheet.

In the case that the supporting element is made of resin, the heat conductivity can not only be changed in the thickness direction of the graphite sheet by means of the interlocking element and the graphite sheet, but also the graphite cladding laminate structural material can be formed which is light in weight and has an arbitrary shape.

In the case that the supporting element is made of paper, the heat conductivity can not only be changed in the thickness direction of the graphite sheet by means of the interlocking element and the graphite sheet, but also the graphite cladding laminate structural material which is light in weight can be formed at a low price.

Therefore, the graphite cladding laminate structural material according to the invention can be used as heat radiation elements having a graphite cladding laminate structure which has a good heat conductivity. For example, heat radiation elements such as radiation fins of heating elements of the heater, radiation fins of radiators and heat sinks of electrical parts can be minimized and lightened.

And the graphite cladding laminate structural material according to the invention can be used as a heat radiation board having a graphite cladding laminate structure, with the result that the heat generated from electrical parts installed on circuit boards can be conducted efficiently.

The graphite cladding laminate structural material according to the invention can be used as a magnetic shielding element, with the result that the heat can not only be conducted, but also magnetism can be shielded.

BRIEF DESCRIPTION OF THE DRAWINGS

These and other objects and features of the present invention will become apparent in the following description of the preferred examples taken in connection with the accompanying drawings in which.

DETAILED DESCRIPTION

Manufacturing Example

Polypyromellitimide containing 5% by weight of calcium hydrogen phosphate and having a thickness of 25 μm (manufactured by DuPont, Capton H Film) was preheated by heating up to 1000° C. at the rate of 3° C./min in nitrogen gas with the LTF-S type electric furnace manufactured by SANKYODENRO co.,ltd. and maintaining at 1000° C. for 1 hour. Next, the resulting carbonated sheet was put inside of the graphite cylinder in a way to expand and contract freely and heated up to 2800° C. at the rate of 5° C./min together with the graphite cylinder with the very high temperature furnace of 46-5 type manufactured by SHIN-SEIDENRO co.,ltd. The heat treatment was performed in argon atmosphere under atmospheric pressure. The resulting sheet was rolled by passing through between two rollers of stainless. The sheet could be obtained which has a tensile strength of 630 kgf/cm$^2$ and a heat conductivity of 860 kcal/mh° C.

EXAMPLE 1

Figure 1:
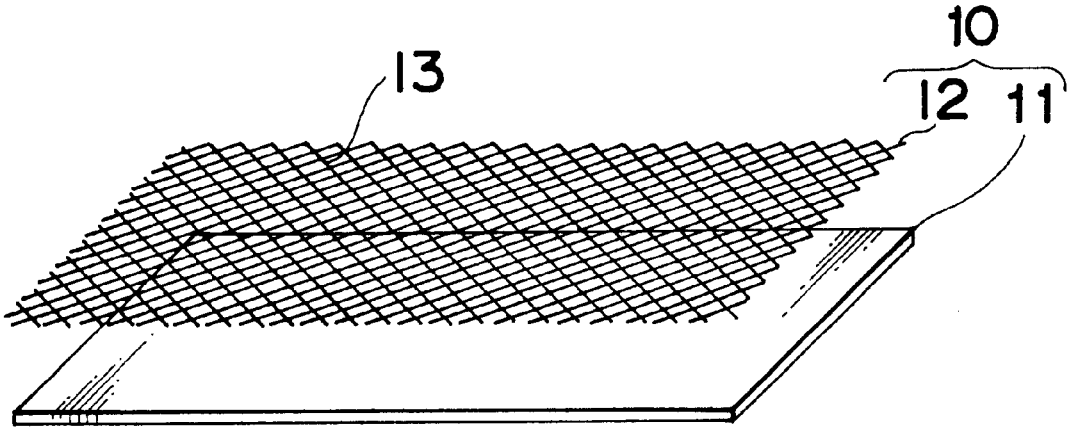
FIG. 1 is a perspective view of a graphite cladding sheet according to an example of the invention.
Figure 2:
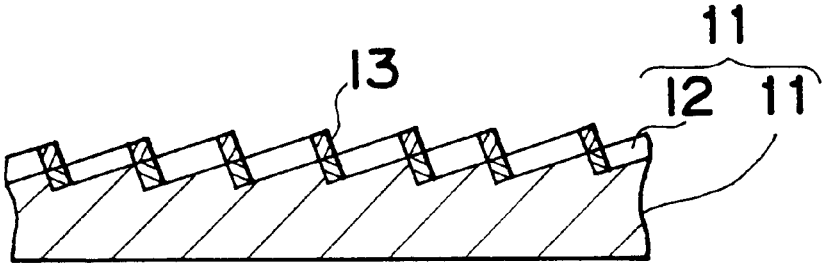
FIG. 2 is an enlarged sectional view of the graphite cladding sheet shown in FIG. 1.

FIG. 1 is an exploded perspective view of a graphite cladding sheet according to the present invention and FIG. 2 is an enlarged sectional view of FIG. 1. In these figures, the graphite cladding sheet 10 has a structure in which the aluminum lathe plate 12 (an example of the supporting element) is fixedly laminated on the flexible graphite film 11. The flexible graphite film 11 is one made in Manufacturing Example 1. The flexible graphite film 11 has a graphite crystalline orientation in a surface extending direction of the graphite sheet and a Rocking characteristics of less than 20 degrees. The lathe plate 12 has a mesh grid 13. The grid 13 is piled up and thereby, the plate has recesses and projections in the crossing direction with the surface. The lathe plate 12 is fixedly laminated on the graphite film 11 by engaging the projections of the grid 13 by generally half depth in the graphite film 11.

Figure 3:
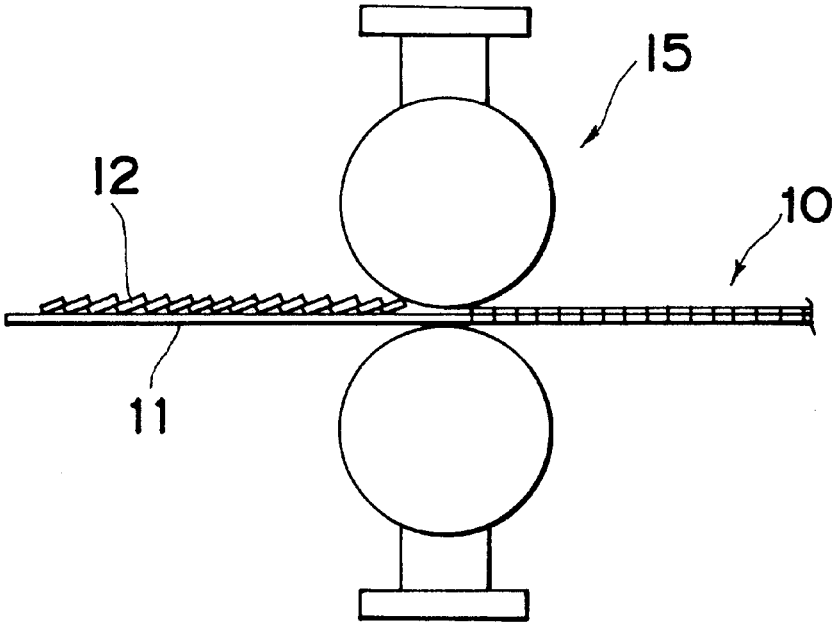
FIG. 3 is a perspective view illustrating the method of making the graphite cladding sheet.

As shown in FIG. 3, the graphite cladding sheet 10 is made by laminating the lathe plate 12 on the graphite sheet 11 and rolling them with the roll presser 15.

Thus, the lathe plate 12 is fixedly laminated on the flexible graphite sheet 11, with the result that the graphite film 11 can be reinforced and the mechanical strength of the graphite cladding sheet 10 can be enhanced. And the flexible graphite sheet allows the graphite cladding sheet to have an arbitrary shape fitting that of the supporting element.

Moreover, when the lathe plate 12 is engaged not by half depth but by whole depth in the graphite film, the crystalline structure of the graphite film 11 is broken off, with the result that the heat conductivity can be changed in the thickness direction of the graphite cladding sheet 10. That is, since the crystalline structure of the graphite film 11 is broken off by the grid 13 of the lathe plate 12 at the part of the graphite cladding sheet 10 in which the lathe plate 12 is engaged, the heat is difficult to conduct. On the other hand, at the part of the graphite cladding sheet 10 in which the lathe plate 12 is not engaged, the performance which high orientation graphite has originally is displayed and the heat can be conducted efficiently.

And when the lathe plate 12 is engaged, various kinds of sheets and films can be fixedly laminated using the lathe plate 12 as an anchor. For example, according to various film forming methods such as sputtering, plating and so on, a ceramic or metallic thin film can be fixedly laminated using the lathe plate 12 as an anchor, or a semi-cured (B stage) epoxy prepreg can be fixed using a lathe plate 12 as an anchor, and further, a ceramic or resinous sheet can be attached. Thus, the graphite cladding sheet 10 in which the lathe plate is fixedly laminated can enhance the adhesiveness with various kinds of sheets and films.

Moreover, if the lathe plate is made of metal having a magnetic shielding effect such as iron, the graphite cladding sheet can be obtained which has a good heat conductivity and a good magnetic shielding effect.

EXAMPLE 2

Figure 4:
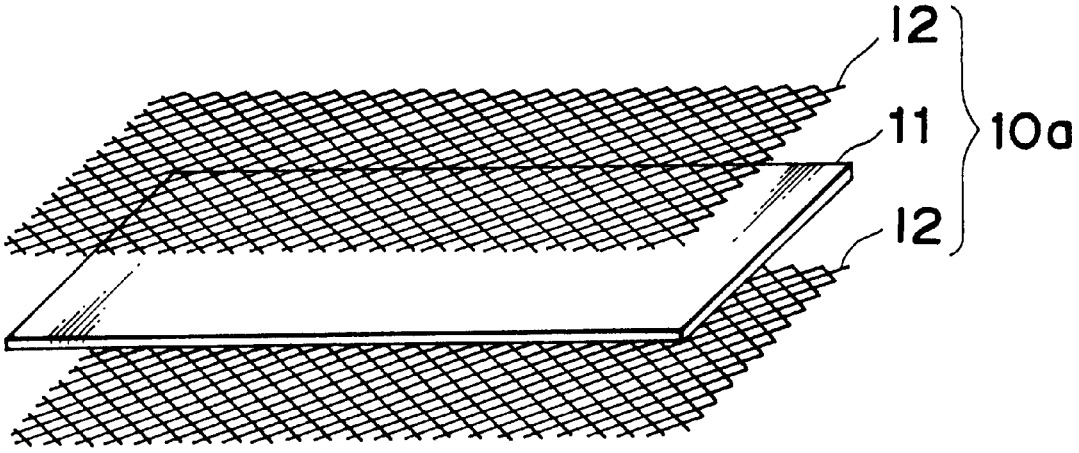
FIG. 4 is a perspective view of a graphite cladding sheet according to Example 2.

Instead of the graphite cladding sheet 10 which has a lathe plate 12 fixedly laminated on one surface of the graphite film 11, as shown in FIG. 4, the graphite cladding sheet 10*a* may be provided which comprises lathe plates 12 fixedly laminated on both surfaces of the graphite sheet 11. Since the graphite cladding sheet 10*a* comprises lathe plates 12 covering the both surfaces of the graphite film 11, various kinds of films and sheets can be fixedly laminated on both surfaces of the sheet. The fixing method similar to Example 1 may be used.

EXAMPLE 3

Figure 5:
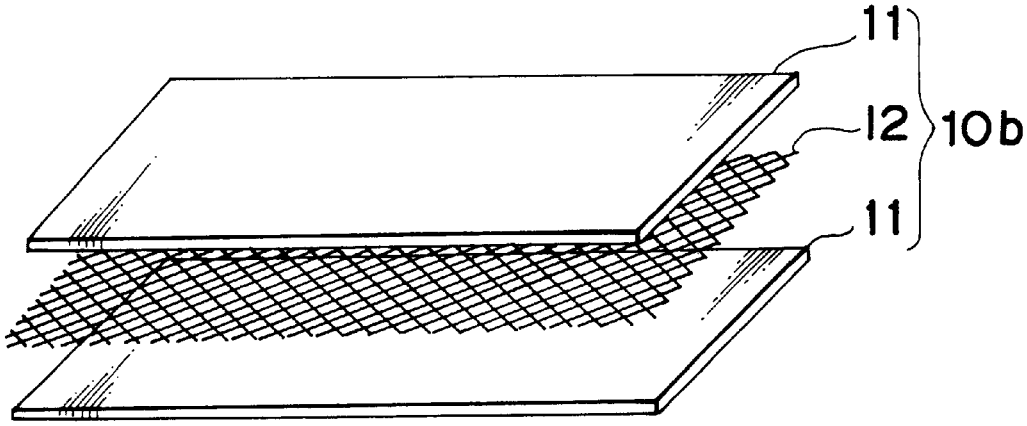
FIG. 5 is a perspective view of a graphite cladding sheet according to Example 3.

As shown in FIG. 5, the graphite cladding sheet 10*b* may be provided which comprises graphite films 11 fixedly laminated on both surfaces of the lathe plate 12. According to Example 3, both surfaces of the lathe plate can be covered with the graphite film 11, with the result that the adhesiveness with other sheets or film is inferior to two examples described above, but the heat conductivity can be enhanced.

EXAMPLE 4

Figure 6:
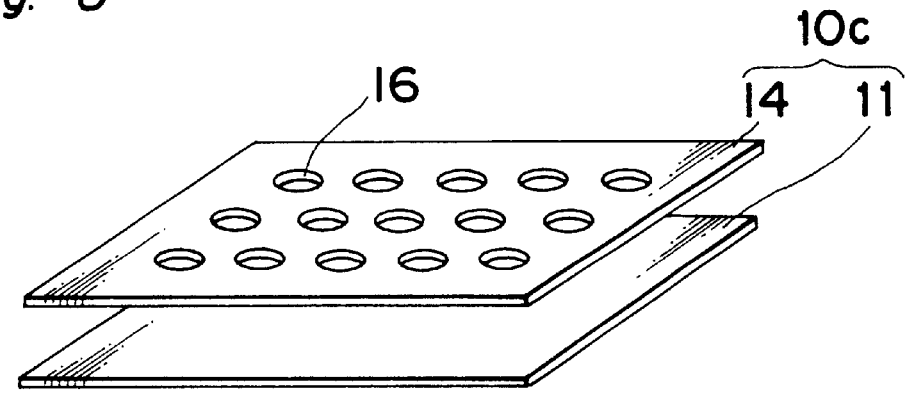
FIG. 6 is a perspective view of the graphite cladding structure according to Example 4.
Figure 7:
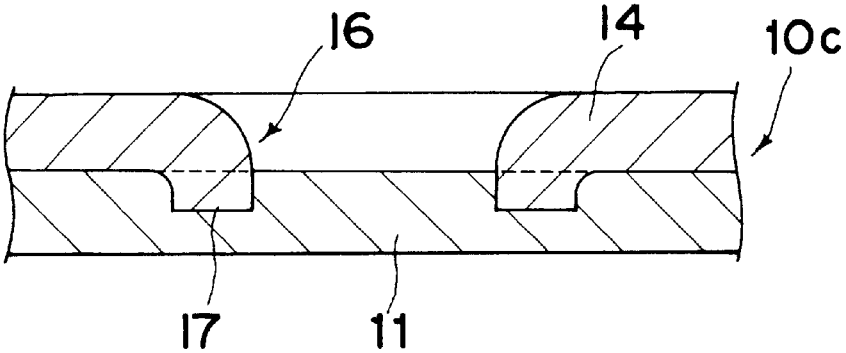
FIG. 7 is an enlarged sectional view of the graphite cladding structure shown in FIG. 6.

As shown in FIG. 6, the graphite cladding sheet 10*c* may be provided which comprises an aluminum punching plate 14 fixedly laminated on the graphite film 11. The punching plate 14 has round holes lengthwise and breadthwise. As shown in FIG. 7, the projection 17 projecting downward surrounds the round hole 16. The punching plate 14 is fixedly laminated on the graphite film 11 by engaging the projection 17 in the graphite film 11. This graphite cladding sheet 10*c* provides the same effect as the sheet in which the lathe plate 12 is fixedly laminated and can enhance the adhesiveness with various kinds of sheets and films.

Moreover, the round hole 16 can be used as a through hole and therefore, the graphite cladding sheet 10*c* is suitable for a radiation board used for a printed board.

EXAMPLE 5

Figure 8:
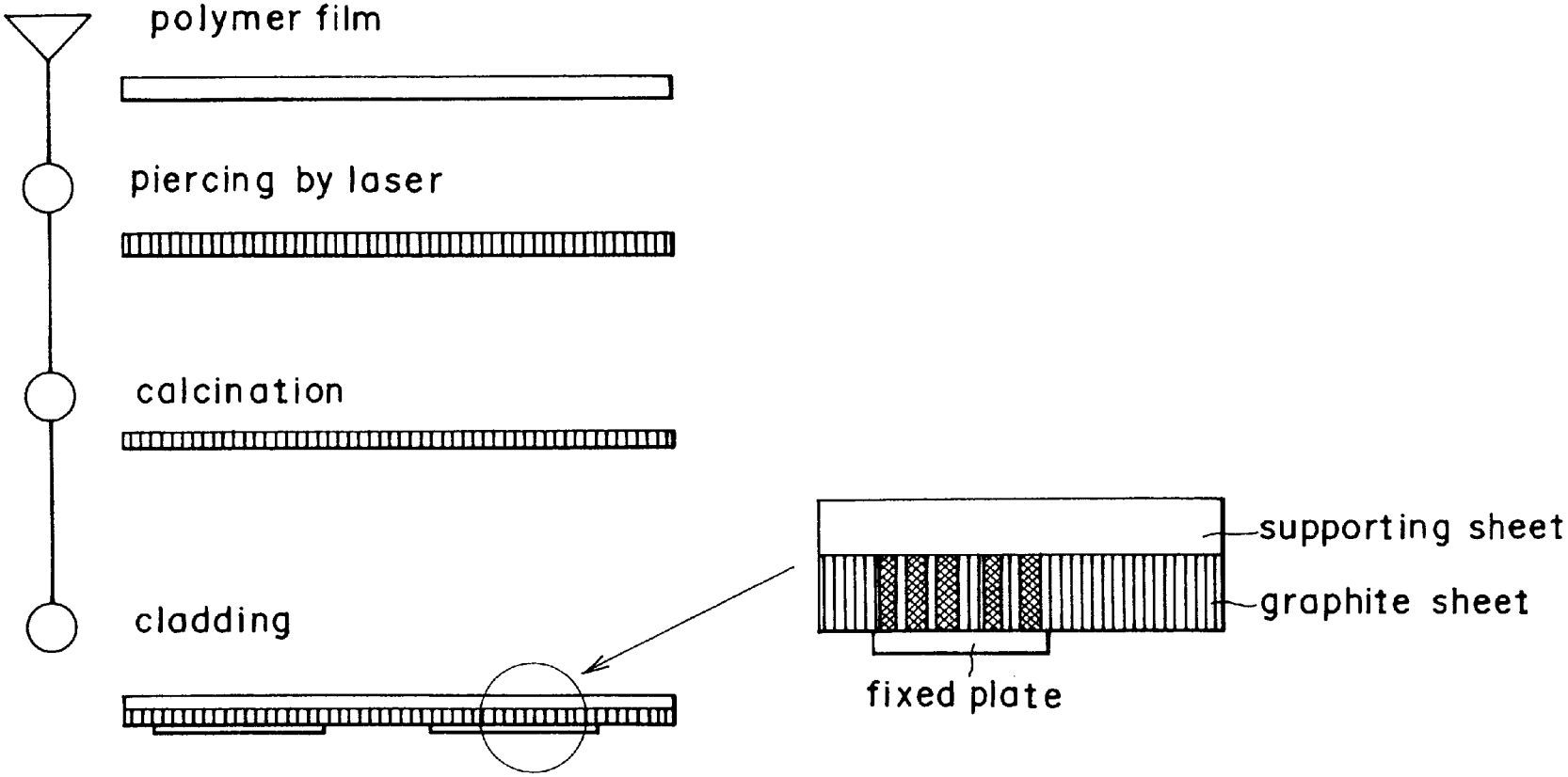
FIG. 8 is a flow diagram illustrating the steps of forming the graphite cladding sheet according to Example 5.

As shown in FIG. 8, 200 aromatic polyimide films of 25 μm (from DuPont Co., Ltd. Capton H Film) are laminated to prepare a film laminate and pierced by laser to provide the plural holes 23 at the part where the adhesion is conducted. The laminate 21 is calcinated in the same way as Manufacturing Example 1 and rolled to form a graphite sheet 22. The adhesive 24 is filled in said holes. The supporting sheet 25 is placed on the upper surface of the graphite sheet 22 and the fixed plate 26 at the part of the under surface where said holes are provided. The supporting sheet 25 and the fixed plate 26 are bonded with said adhesive 24 while the pressure is put from upper and under surfaces, so as to hold said graphite sheet between the supporting sheet 25 and the fixed plate 26.

Said supporting sheet 25 and said fixed plate 26 are usually made of the same material. Therefore, in the case that said both elements are made of metal, they are bonded using a metal bond paste such as a solder, platinum and indium as an adhesive, resulting in the achievement of a strong bonding without the obstruction of the electric conductivity and heat conductivity in a surface extending direction of said graphite sheet.

In the case that said both elements are made of resin, they may be bonded strongly using an electrically conductive adhesive, heat conductive paste and so on. And in the case that said both elements are made of a ceramic, they may be bonded strongly using a sintering paste of the same powder material.

EXAMPLE 6

Figure 9:
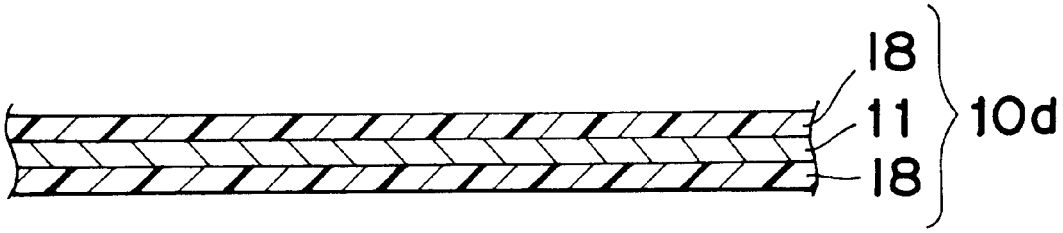
FIG. 9 is a sectional side elevation of a graphite cladding sheet according to Example 6.
Figure 10:
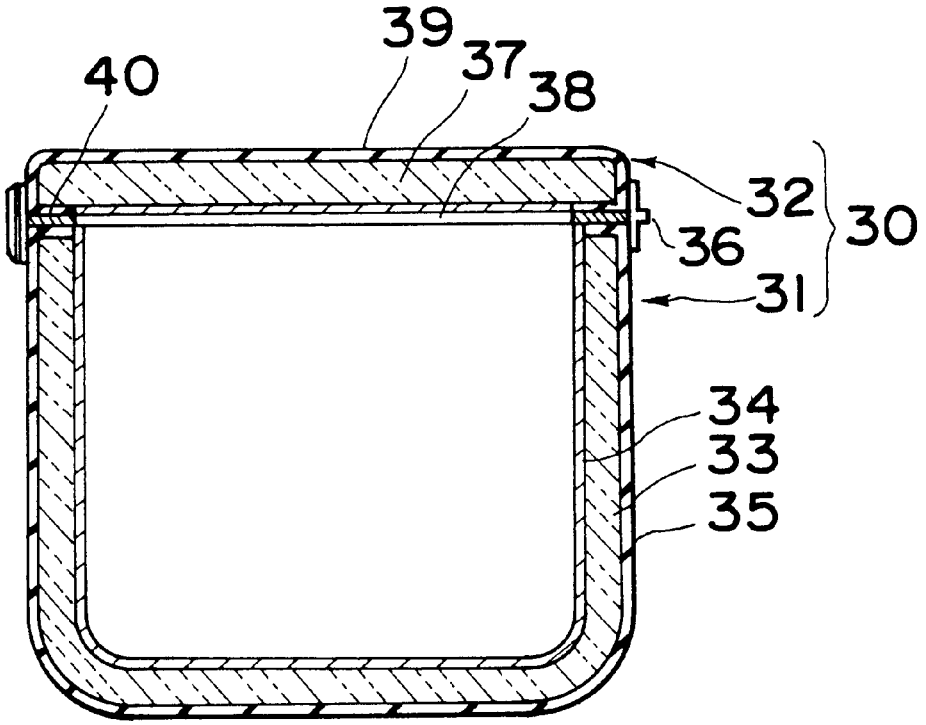
FIG. 10 is a sectional view of a heat reserving box using the graphite cladding sheet according to the invention.

As shown in FIG. 9, the graphite cladding sheet 10*d* may be provided which comprises the plates 18 made of resin such as acrylic resin, styrene resin, epoxy resin and synthetic rubber are fixedly laminated on both surfaces of the graphite film 11. The adhering method with the epoxy prepreg or due to insert molding may be used as a fixing method. Since the heat conductivity is extremely different between graphite and resin, this graphite cladding sheet 10*d* can provide a material in which the heat conductivity is extremely different between the right and the wrong sides of the graphite cladding sheet 10*d*. And instead of the resin plate 18, the ceramic plate or the paper may be fixedly laminated on the graphite film 11, resulting in the same effect.

EXAMPLE 7

Figure 11:
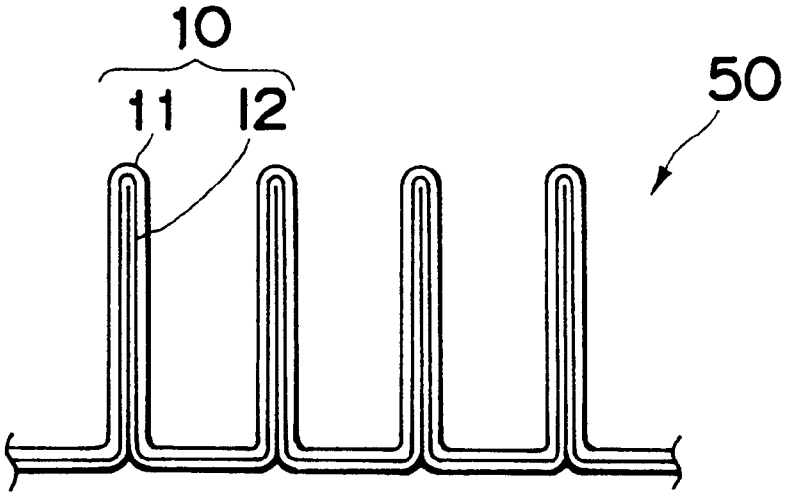
FIG. 11 is a fragmentary side view of a heat sink using the graphite cladding sheet according to the invention.

FIG. 11 is a sectional view of the heat reserving box 30 using the graphite cladding sheet according to Example 7 of the present invention.

The heat reserving box 30 comprises a body 31 of the heat reserving box with the upper surface open and a top door 32 for opening and closing the body 31 of the heat reserving box. The opening of the body 31 of the heat reserving box is provided with a packing 40 which contacts the top door 32. The body 31 of the heat reserving box comprises a box type adiabatic case 33 made of styrene foam with an upper surface open, a graphite film 34 fixed on the inner surface the adiabatic case 33, and an outer case 35 made of steel covered with vinyl chloride which is adhered to the outer surface of the adiabatic case 33. The top door 32 is installed at the top end of the body 31 of the heat reserving box closably on the hinges 36. The top door 32 comprises a flat board type heat insulating element 37 made of styrene foam, a graphite film 38 fixed on the inner surface of the heat insulating element 37 and an outer element 39 made of steel covered with vinyl chloride which is adhered to the outer surface of the heat insulating element 37. The adiabatic case 33 and the graphite film 34, and the heat insulating element 37 and the graphite film 38 construct graphite cladding structures, respectively.

The heat reserving box 30 having such a structure is provided with a graphite film inside and therefore, the temperature is readily uniform in the heat reserving box and the heat is confined to the inside, with the result that the heat cannot be easily emitted outwardly.

EXAMPLE 8

FIG. 11 is a side view illustrating a heat sink using the graphite cladding sheet according to Example 8 of the present invention.

The heat sink 50 is positioned in contact with a semiconductor such as CPU or a power transistor. The heat sink 50 has a shape obtained by bending like a hairpin the graphite cladding sheet 10 which comprises a lathe plate fixedly laminated on the graphite sheet 11 and sticking it. The heat sink 50 is easily prepared only by bending the graphite cladding sheet 10.

EXAMPLE 9

Figure 12:
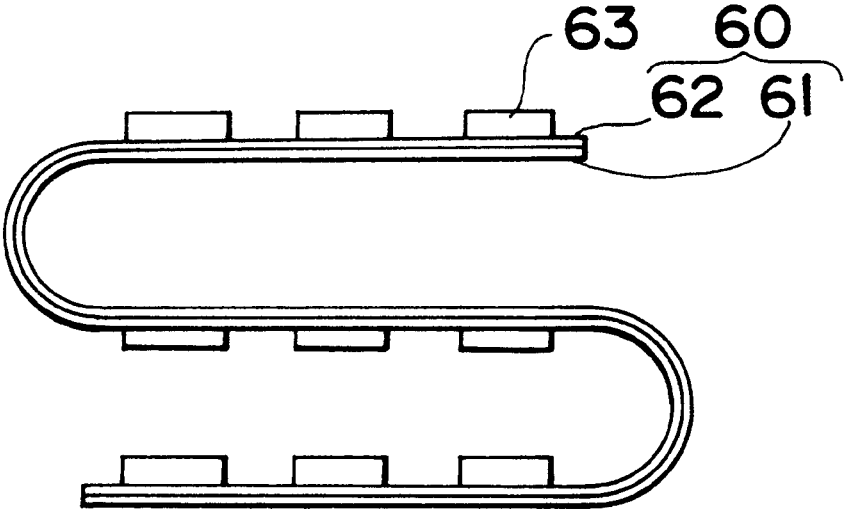
FIG. 12 is a side view of a flexible printed board using the graphite cladding sheet according to the invention.

FIG. 12 is a side view illustrating a flexible printed board using the graphite cladding sheet according to Example 9 of the present invention.

Figure 13:
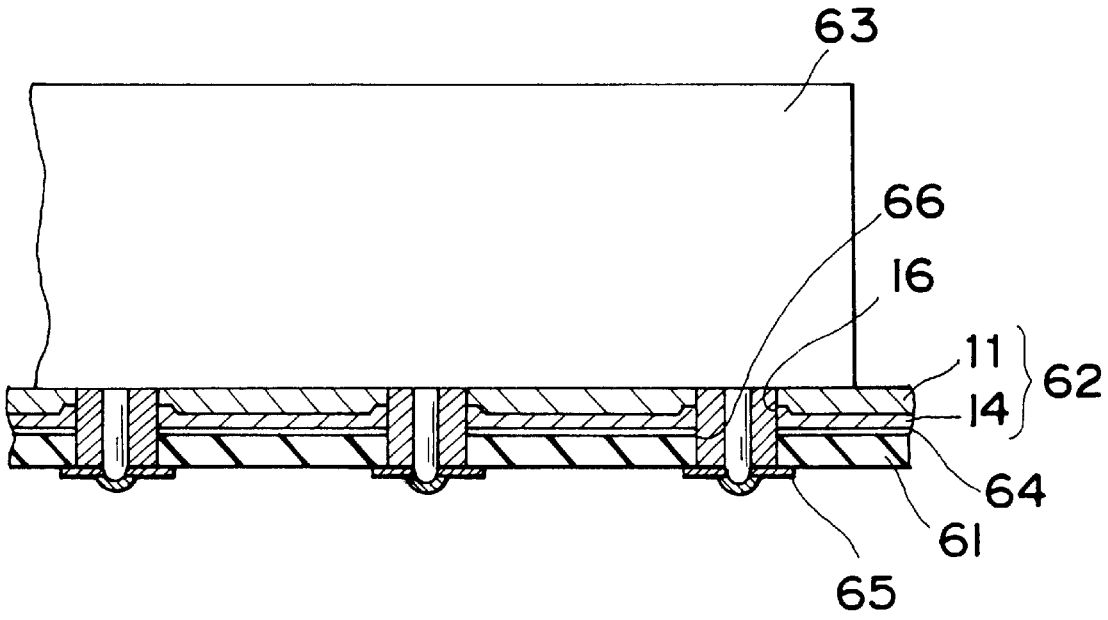
FIG. 13 is an enlarged sectional view of the flexible printed board shown in FIG. 12.
Figure 14:
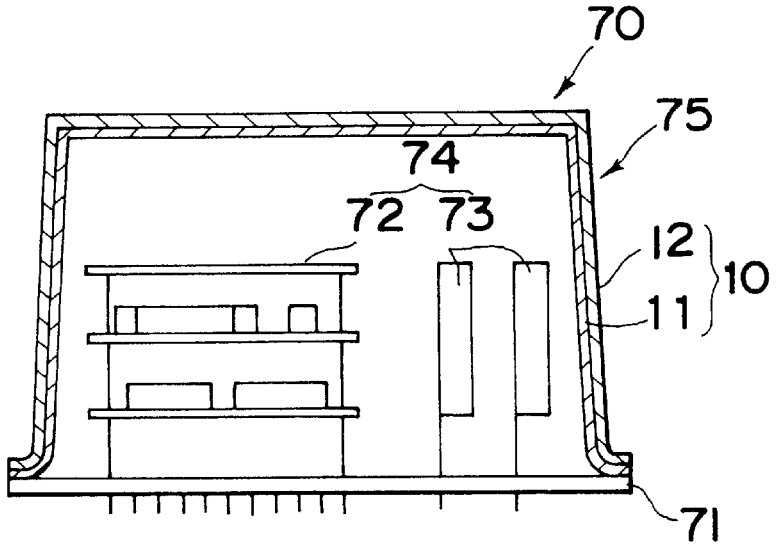
FIG. 14 is a sectional view of tuning parts using the graphite cladding sheet according to the invention.

The printed board 60 is bent into S shape and comprises a flexible board 61 made of resin, for example, polyimide, and a radiation board 62 using the graphite cladding sheet 10*c* as shown in FIG. 6. The printed board 60 is provided with various kinds of electronic parts 63 such as LSI with pins. The resin board 61 is, as shown in FIG. 14, adhered to the punching board 14 of the radiation board 62 with B stage epoxy prepreg 64. The round hole 16 of the punching board 14 is provided with a through hole 66 for allowing the pin 65 of the electronic parts 63 to pass through. The wiring pattern is formed on the underside of the resin board 61 of FIG. 13 and the wiring pin 65 is soldered on the land.

EXAMPLE 10

FIG. 14 is a sectional view of a tuning part using the graphite cladding sheet according to Example 10 of the present invention. The tuning part 70 comprise a printed board 71, electronic parts 74 including MCM 72 and sealed miniature circuits 73 mounted on the printed board 71 and a case 75. The case 75 shields the electronic parts 74 magnetically and radiates heat generated from the electronic parts 74. The case 75 is formed by bending or molding the graphite cladding sheet which comprises the lathe plate 12 fixedly laminated on the graphite film 11 as shown in FIG. 1. Since the electronic parts 74 are covered with the case 75 using the graphite cladding sheet and magnetically shielded, the electronic parts 74 are hard to be influenced by magnetism from the outside and magnetism generated from the electronic parts 75 is hard to leak out.

EXAMPLE 11

Figure 15:
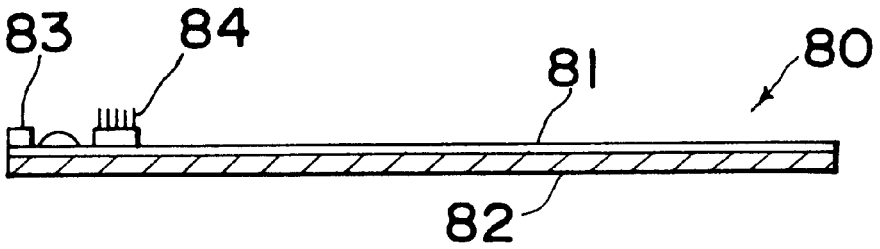
FIG. 15 is a sectional view of a heating and cooling sheet using the graphite cladding sheet according to the invention.
Figure 16:
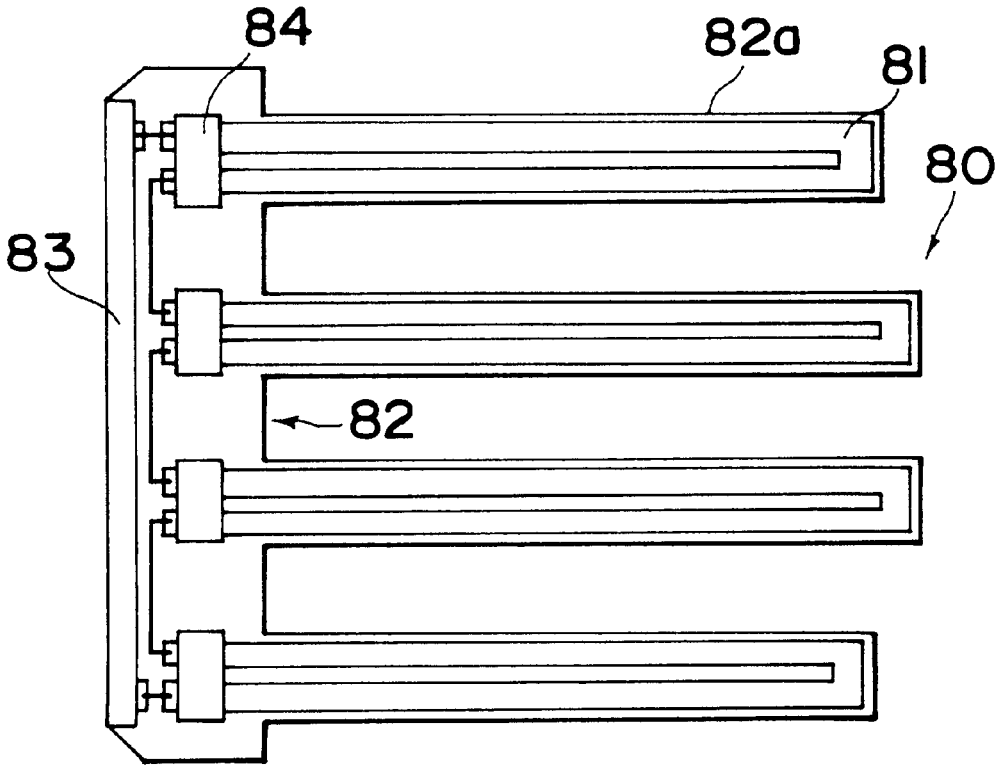
FIG. 16 is a plan view of the heating and cooling sheet shown in FIG. 15.

FIG. 15 and FIG. 16 illustrate a seat for heating and cooling using the graphite cladding sheet according to Example 11 of the present invention. The seat for heating and cooling 80 comprises four U-shaped graphite sheets 81 and a flexible resin sheet 82 having four projections 82*a* like the teeth of a comb on which the graphite sheet 81 is fixedly laminated. Each graphite sheet 81 is connected in series and its both ends are connected to the heater circuit 83. When 12 V d.c. voltage is applied to the graphite sheet 81 through the heater circuit 83, the seat functions as a heater. A Pertie element is positioned in contact with the end of the graphite sheet 81 to make cooling possible. This seat for heating and cooling 80 is suitable to a sound sleeping pillow and an automobile seat. The graphite sheet 81 has a good heat radiation property and therefore, it is possible to cool naturally without a Pertie element.

EXAMPLE 12

Figure 17:
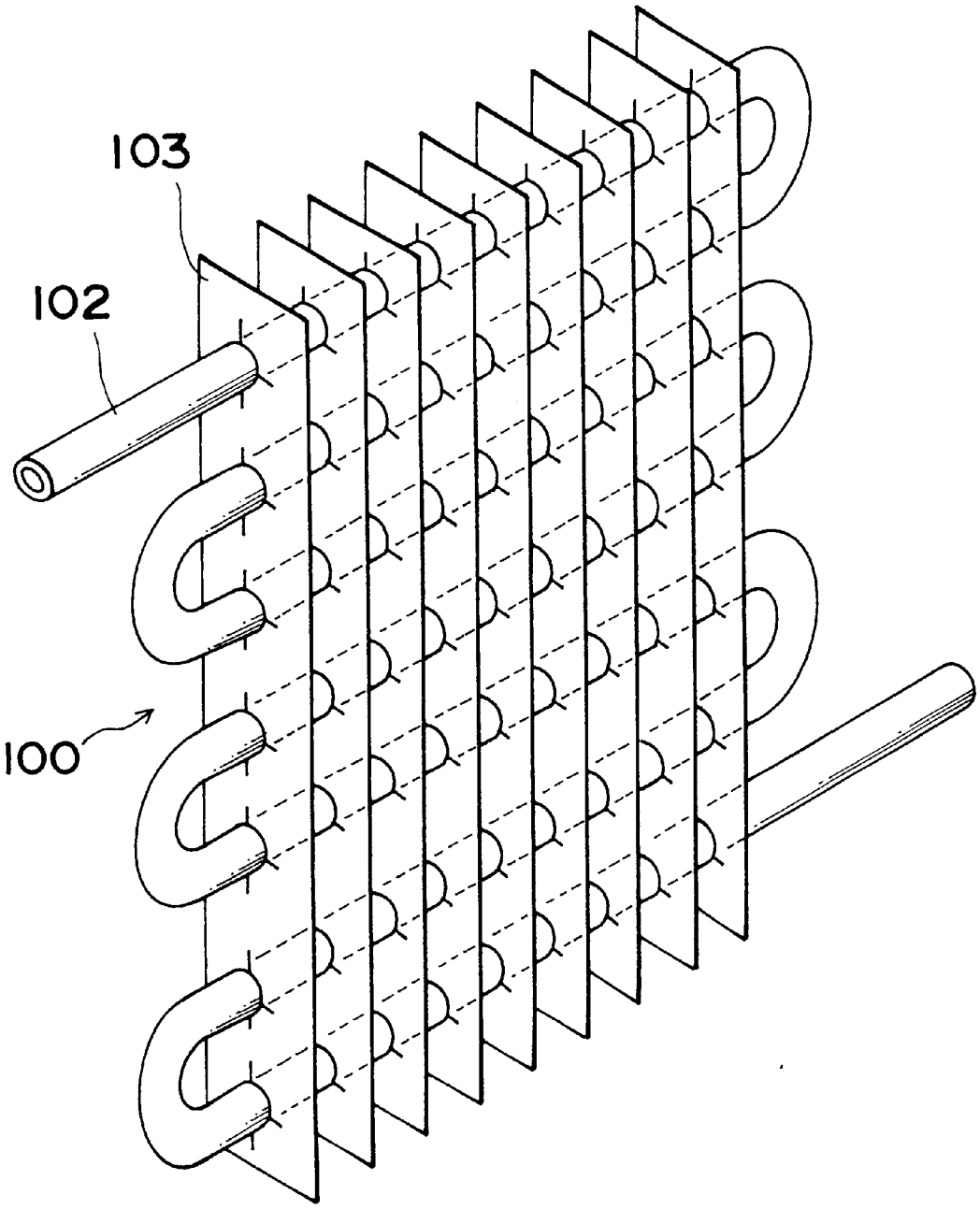
FIG. 17 is a perspective view of a heat exchanger using the graphite cladding sheet according to the invention.

FIG. 17 is a perspective view of a heat exchanger having a heat radiation structure according to an embodiment of the present invention.

In this figure, the heat exchanger 100 comprises a bent copper pipe 102 and a radiation fin 13 which the copper pipe 102 passes through and is in contact with. The copper pipe 102 lets the fluid such as heating vapor and cooling water pass through and is formed by bending zigzag like a hair pin. The radiation fin 103 is made of the graphite cladding laminate structural material having a high orientation in a surface extending direction made according to Example 1. The fins 103 are arranged in a way that the principal planes are faced to each other in the axial direction of the copper pipe 102.

Figure 18A:
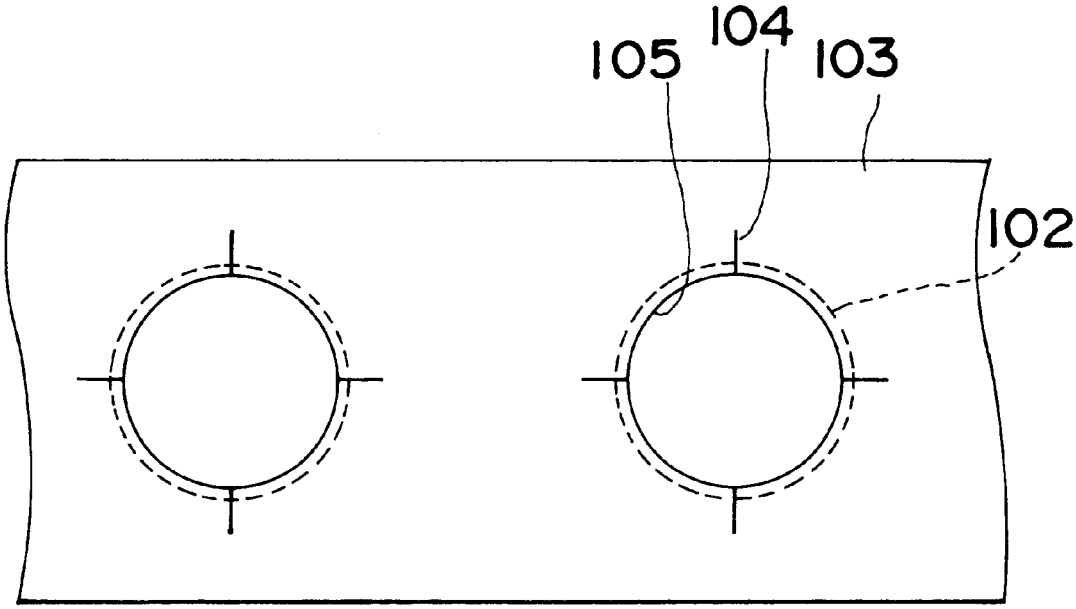
FIG. 18 is an enlarged view of a radiation fin in which the copper pipe is not inserted (A) and is inserted (B)

As shown in FIG. 18A, the radiation fin 103 is provided with a transmitting hole 105 at the part thorough which the copper pipe 102 passes. The slit 104 extending radically is provided around the transmitting hole 105. The inner diameter of the transmitting hole 105 is a little smaller than the outer diameter of the copper pipe 102. Since the inner diameter of the transmitting hole 105 is smaller than the outer diameter of the copper pipe 102, it can be ensured that the surface of the radiation fin 103 becomes in contact with the one of the copper pipe 102 at the time when the copper pipe 102 is inserted into the radiation fin 103. Moreover, it can be ensured that the radiation fin 103 is in contact with the copper pipe 102 by means of an easy inserting operation without passing a steel ball and the like through the copper pipe 102.

In this heat exchanger 100, when the fluid such as heating vapor and cooling liquid passes through the copper pipe 102, the heat is conducted to the radiation fin 103 and radiated in the air, with the result that heat is exchanged to cool or heat the fluid. Since the radiation fin 103 is made of the graphite sheet having a high orientation, the heat conductivity is higher than that of aluminum and therefore, the heat exchanger 100 can be minimized and lightened. And the radiation fin is reinforced by the lathe plate 12 and therefore, the mechanical strength of the radiation fin 103 is enhanced.

The manufacturing process of the heat exchanger 100 will be described in the following part.

Figure 19A:
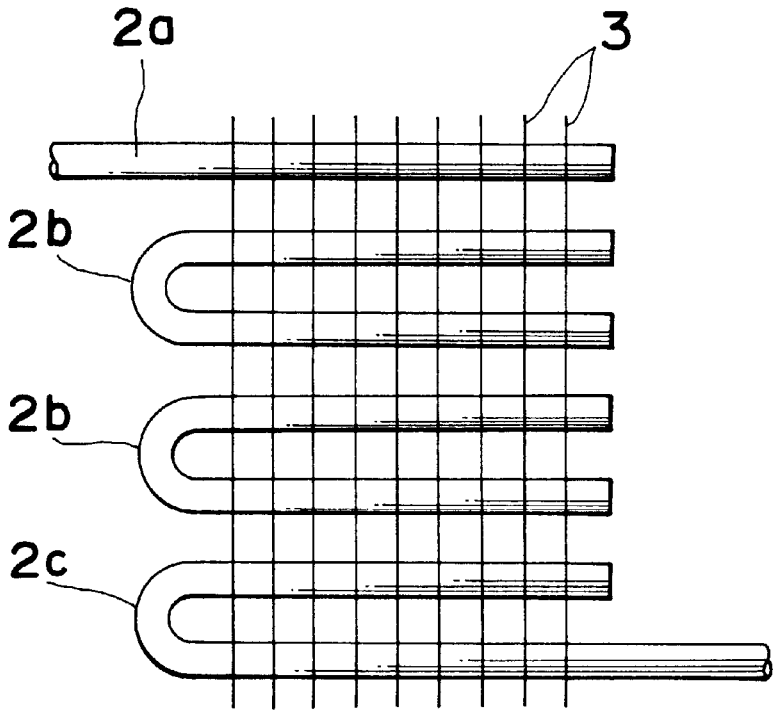
FIG. 19 illustrates the procedure of making the heat exchanger shown in FIG. 17; (A) illustrates the state that the U vent is not installed at the open end of the copper pipe and (B) illustrates the state that the U vent installed.

First, a linear copper pipe 102*a,* hair-pin shaped copper pipes 102*b,* a hair pin shaped copper pipe with one end extending 102*c,* U-shaped bend 102*d* and radiation fins 103 are prepared. The radiation fins 103 are arranged in a way that the principal planes are faced to each other and the copper pipes 102*a* to 102*c* are passed through the transmitting holes 105, respectively. As a result, as shown in FIG. 19A, the copper pipes 102*a* to 102*c* are arranged vertically and the radiation fins 103 are lined up in the axial direction of the copper pipes 102*a* to 102*c*.

Figure 18B:
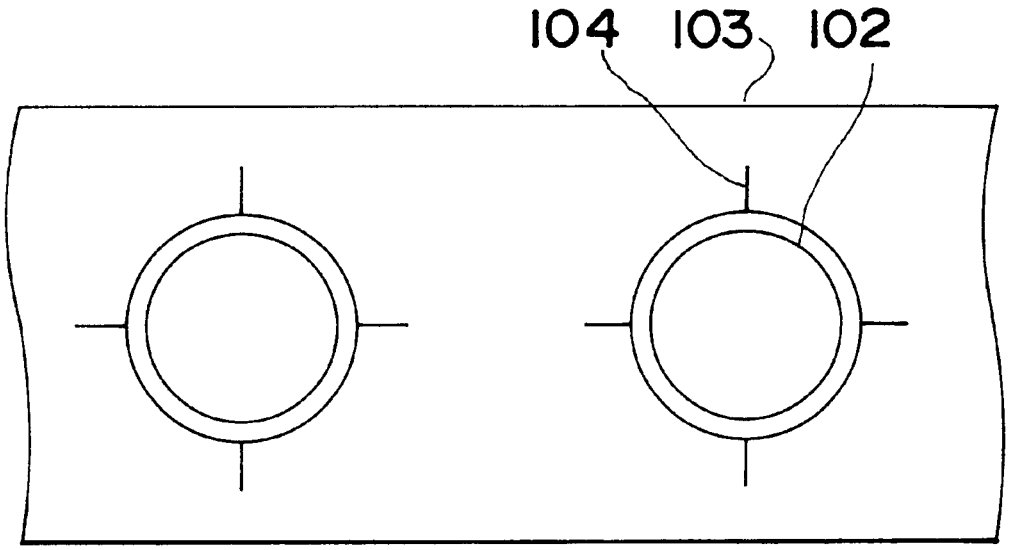

According to this example, as shown in FIGS. 18A and 18B, the inner diameter of the transmitting hole 105 is smaller than that of the copper pipe 102 and therefore, the radiation fin 103 bends due to the slit 104 at the time when the copper pipe is passed through the hole, with the result that the radiation fin 103 is sure to come in contact with the surrounding surface of the copper pipe 102. And since the radiation fin 103 bends due to the slit 104, the copper pipe can be easily passed through the fin.

Figure 19B:
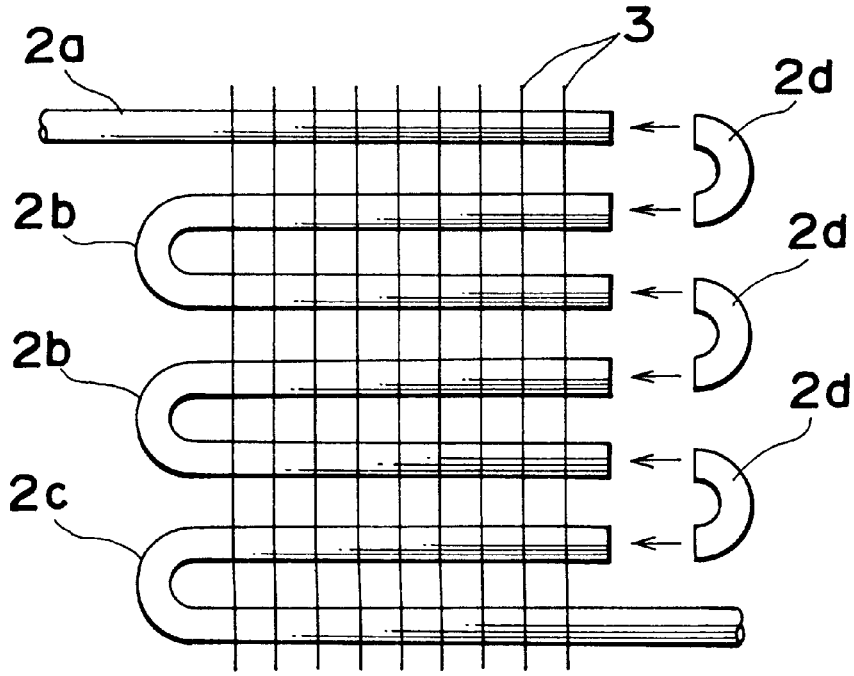

Then, as shown in FIG. 19B, the U-bends 102*d* is adhered, for example, by brazing, to the open ends of the copper pipes 102*a* to 102*c*. As a result, the heat exchanger shown in FIG. 17 is perfected.

Since the radiation fins 103 are made of the graphite cladding sheet having a high orientation in this example, the heat conductivity is high and the heat exchanger can be minimized and lightened and have a high efficiency. The complicated step such as the introduction of the steel ball to contact the radiation fin 103 with the copper pipe 102 can be eliminated and therefore, the heat exchanger 100 can be easily made, compared with the conventional one made by introducing the steel ball into the copper pipe 102.

EXAMPLE 13

Figure 20:
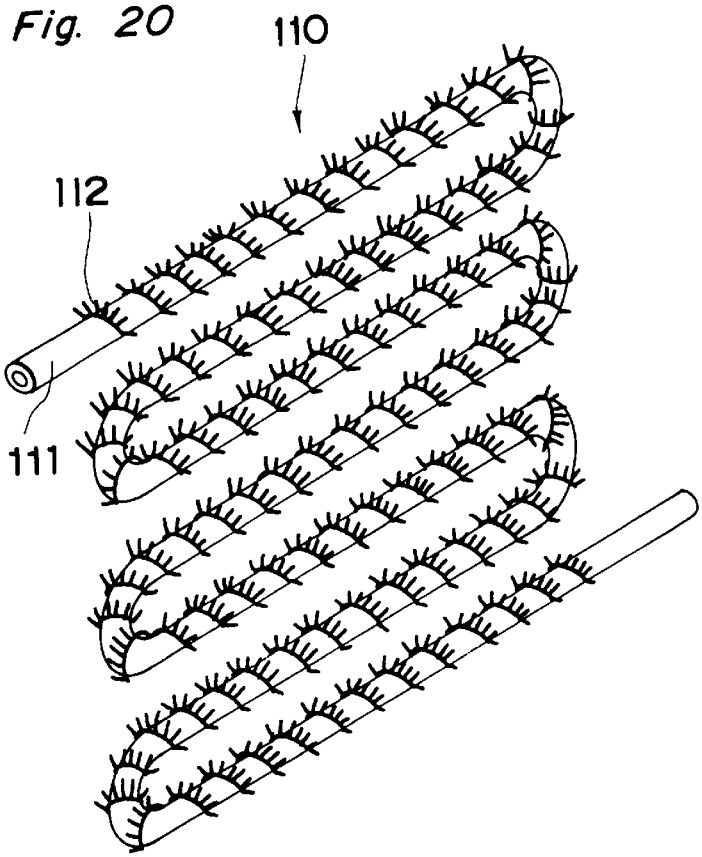
FIG. 20 is a perspective view of a heat exchanger according to Example 13.

FIG. 20 is a perspective view of a heat exchanger 110 having a heat radiation structure according to Example 13 of the present invention.

Figure 21A:
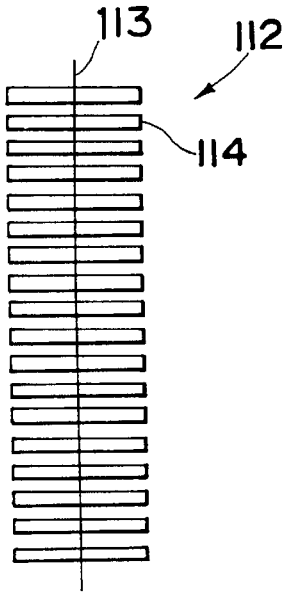
FIG. 21 illustrates the steps of making the heat exchanger shown in FIG. 20; (A) is a plan view of the state that strips are connected in parallel with one another relative to the radiation fin as a center and (B) illustrates the state that the resulting element is spiraled around the copper pipe.
Figure 21B:
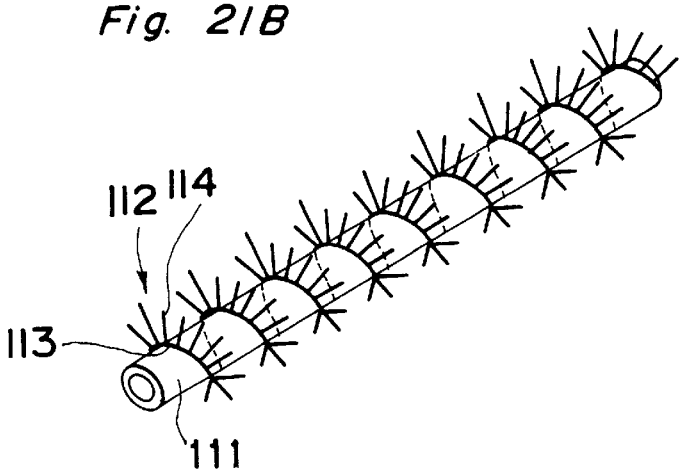

In this figure, the heat exchanger 110 comprises a copper pipe 111 and a radiation fin 112 spiraled around the copper pipe 111. The copper pipe 111 is bent zigzag like a hair-pin. The radiation fin 112 is made by , as shown in FIG. 21A, lining up the strips 114 made of the graphite cladding sheet having a high orientation according to Example 1, adhering them to a core line 113 made of a copper wire or a carbon string and, as shown in FIG. 21B, spiraled around the copper pipe 111. These strips 114 may be ones made of the waste material obtained after the graphite cladding sheet is used for other products.

This heat exchanger 110 is manufactured according to the following process.

First, a copper pipe 111, a core line 113 and strips made of the graphite sheet 114 are prepared. As shown in FIG. 21A, the strips 114 are adhered to the core line 113 to obtain the radiation fin 112. Then, as shown in FIG. 21B, the resulting radiation fin 112 is spiraled around the copper pipe 111 and adhered to it. At last, the copper pipe 111 which the radiation fin 112 is spiraled around is bent zigzag like a hair-pin with a pipe-bender.

In such a heat exchanger 110, the radiation fin 112 can have a much larger surface area. As a result, the heat exchanger can be further miniatured and lightened and have a higher efficiency.

EXAMPLE 14

Figure 22:
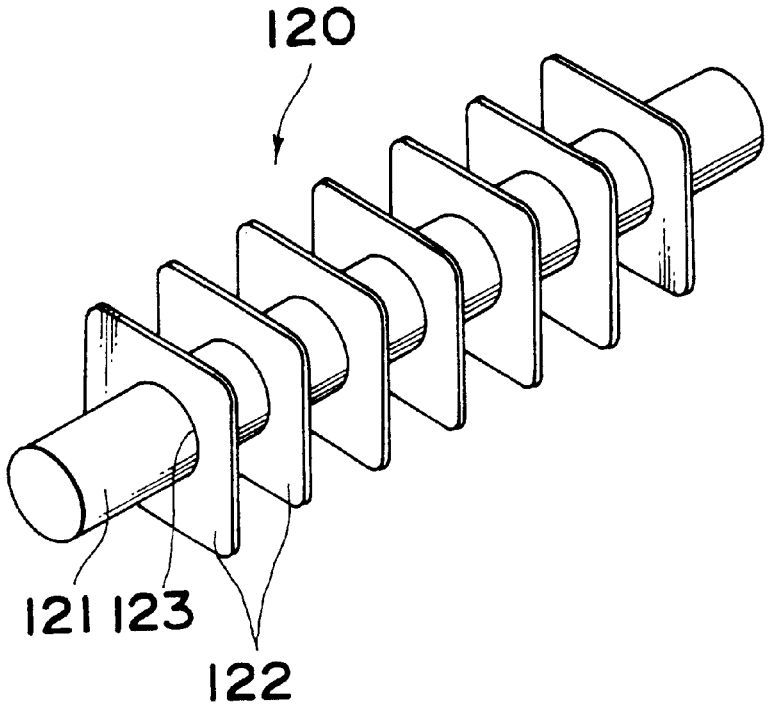
FIG. 22 is a perspective view of the heating device according to Example 14.

FIG. 22 is a perspective view of a heating device 120 having a graphite sheet according to Example 14 of the present invention.

The heating device 120 comprises a bar of sheathed heater 121 and radiation boards 122 which are lined up in the longitudinal direction of the heater 121. The radiation board 122 is a rectangular element and made of, for example, the graphite cladding sheet 10*b* which comprises the graphite films 11 having a high orientation fixedly laminated on both surfaces of the lath plate 12 and has the similar shape to that shown in FIG. 5. The lathe plate 12 may be preferable made of materials having a good heat resistance, for example, nickel chromium material. The radiation board 122 is provided with a transmitting hole 123 in the center. The inner diameter of the transmitting hole 123 is generally equal to the outer diameter of the heater 121.

This heating device 120 is manufactured by lining up the radiation boards 122 having transmitting holes 123 around the heater 121. This heating device 120 comprises radiation boards 122 around the heater 121 and therefore, heat generated from the heater 121 is radiated from the radiation board 122 as well as the heater 121 itself. As a result, the radiation area becomes large and heat can be radiated widely.

EXAMPLE 15

Figure 23:
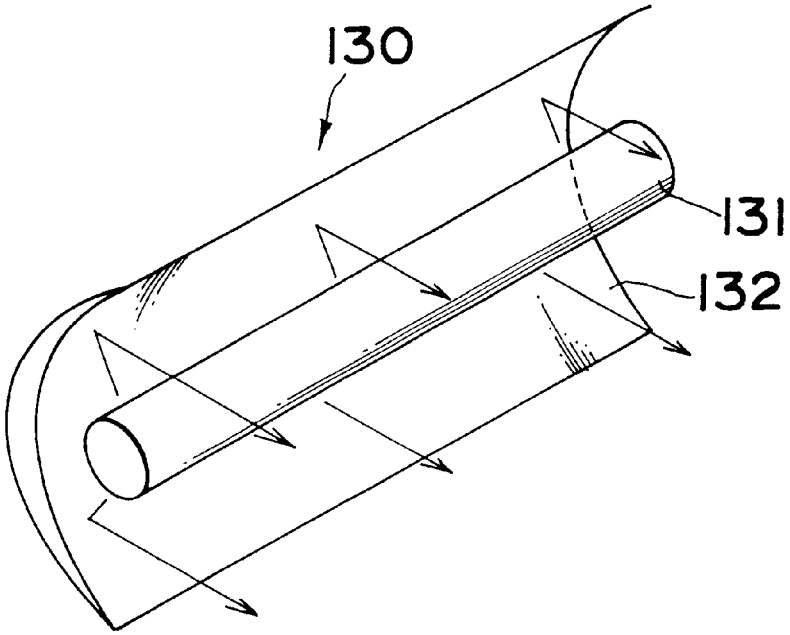
FIG. 23 is a perspective view of a variation of the heating device according to Example 14.

FIG. 23 is a perspective view of a heating device 130 having a heat radiation structure according to Example 15.

The heating device 130 comprises a heater 131 and a radiation board 132 which is curved and positioned at the back of the heater 131. The radiation board 132 is made of graphite having a high orientation and curved, for example, in a way that it describes a parabola.

In this heating device 130, heat generated from the heater 131 is absorbed by the radiation board 132 and radiated, for example, toward the front surface of the heater 131. As a result, the heat radiated toward the rear surface of the heater 131 is radiated efficiently toward the front surface and heat generated from the heater 131 can be conducted in one direction, with the result that heat can be radiated efficiently relative to the heated article.

EXAMPLE 16

Figure 24:
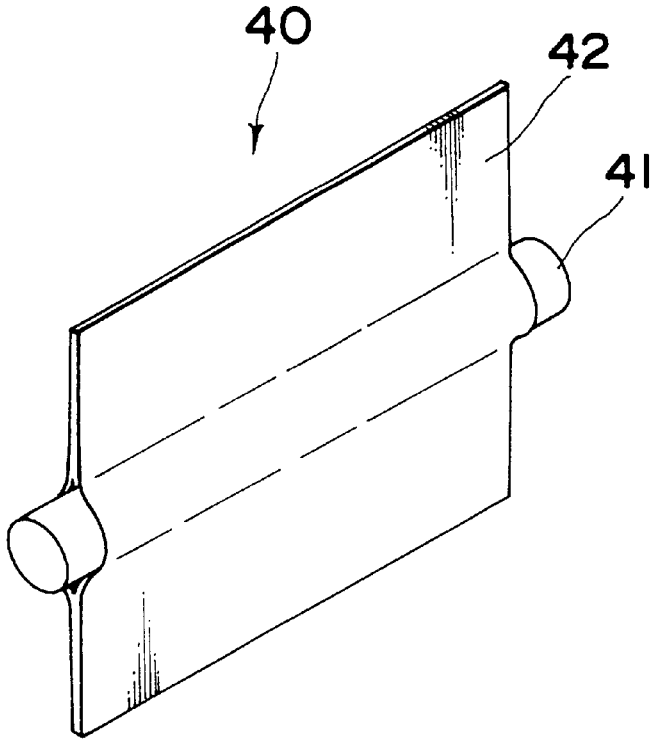
FIG. 24 is a perspective view of a heating device according to Example 15.
Figure 25:
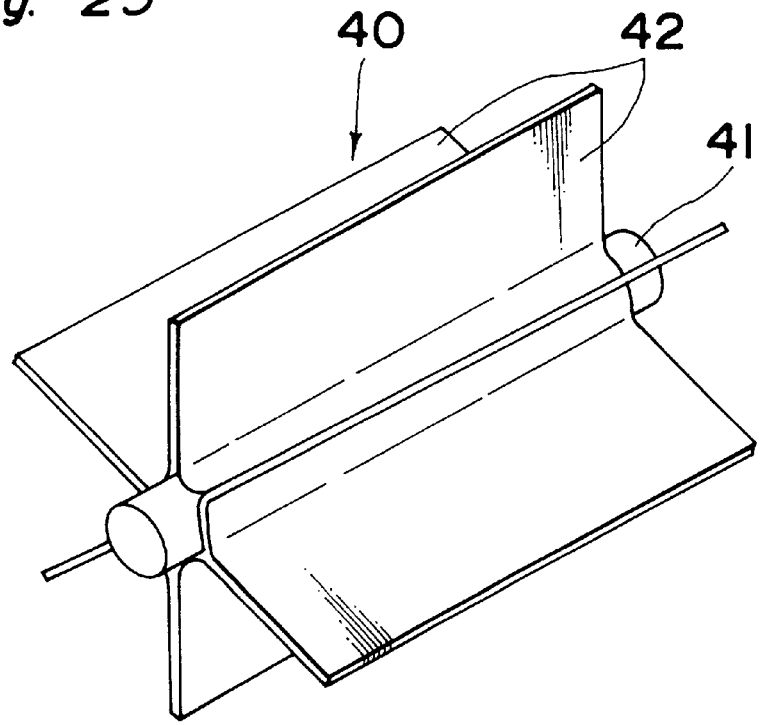
FIG. 25 is a perspective view of a heating device according to Example 16.

FIG. 24 is a perspective view of a heating device 140 having a heat radiation structure according to Example 16.

The heating device 140 comprises a heater 141 and a heat radiation board 142 made of two graphite sheets stuck to the surrounding surface of the heater 141 and extending vertically. The heat radiation board 142 is long in the longitudinal direction of the heater 141 and in contact with the heater 141 and extends radially in the vertical direction.

In this example, heat generated from the heater 141 is conducted to the radiation board 142 and radiated to the front and the rear from the principal plane of the heat radiation board 142. As a result, the radiation area becomes large and heat can be radiated widely.

And any number of radiation boards may be used. For example, as shown in FIG. 6, six radiation boards 142 may be stuck to each other and the surrounding surface in a way that they extend radially. In this case, the radiation area becomes larger and heat can be radiated more widely.

EXAMPLE 17

Figure 26:
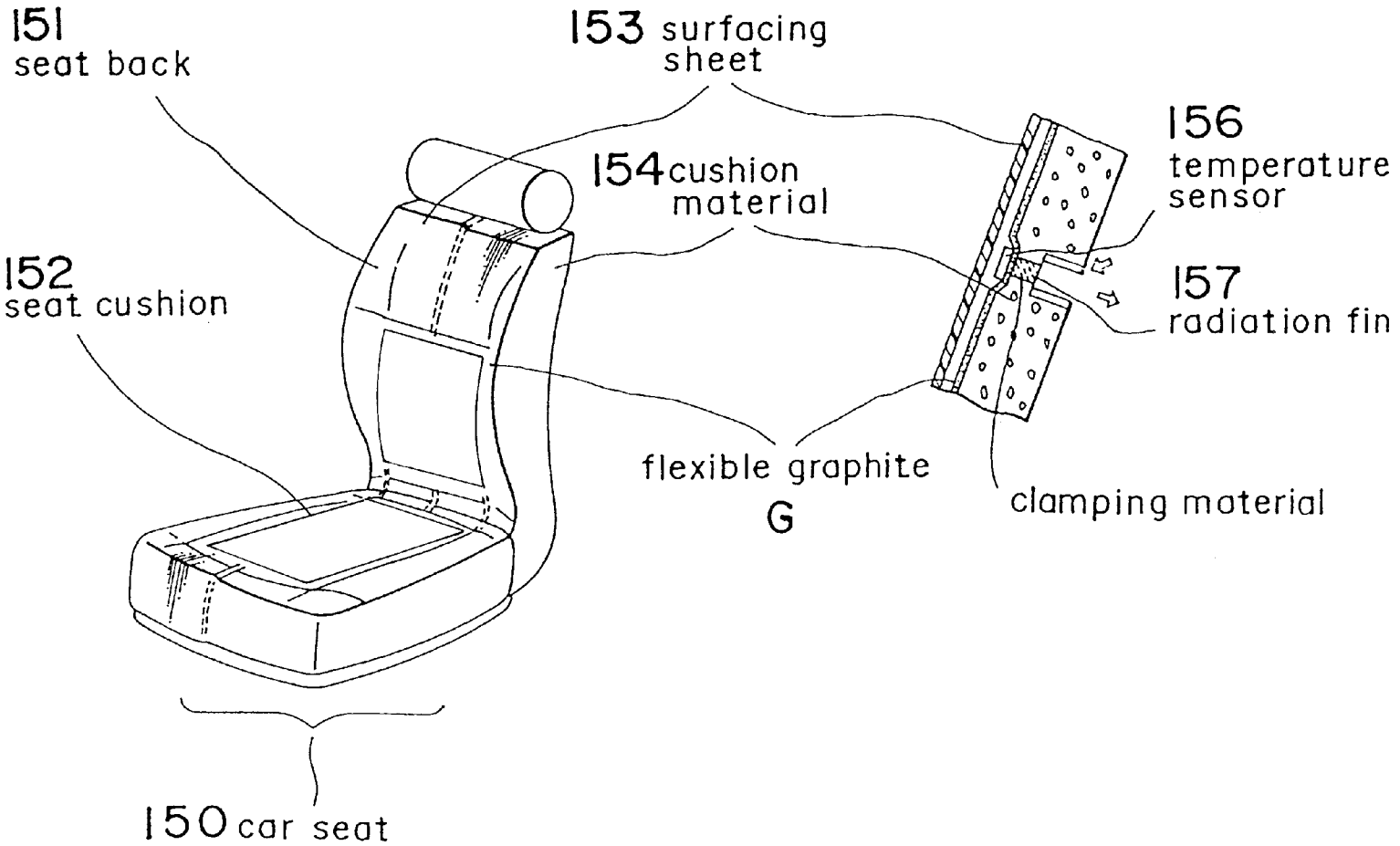
FIG. 26 is a perspective view of a heating device according to Example 17.

FIG. 26 illustrates a seat 150 in which said flexible graphite sheet G having a high orientation of a seat back 151 part and a sheet cushion 152 part are cladded with a surfacing sheet 153 and a cushion material 154 and the graphite sheet G is connected to a Pertie element 155 to heat and cool the graphite sheet. There is provided a temperature sensor near the Pertie element 155 to control the temperature of heating and cooling. The radiation fin 157 is preferably provided at the back of the Pertie element 155 to cool efficiently.

EXAMPLE 18

Figure 27:
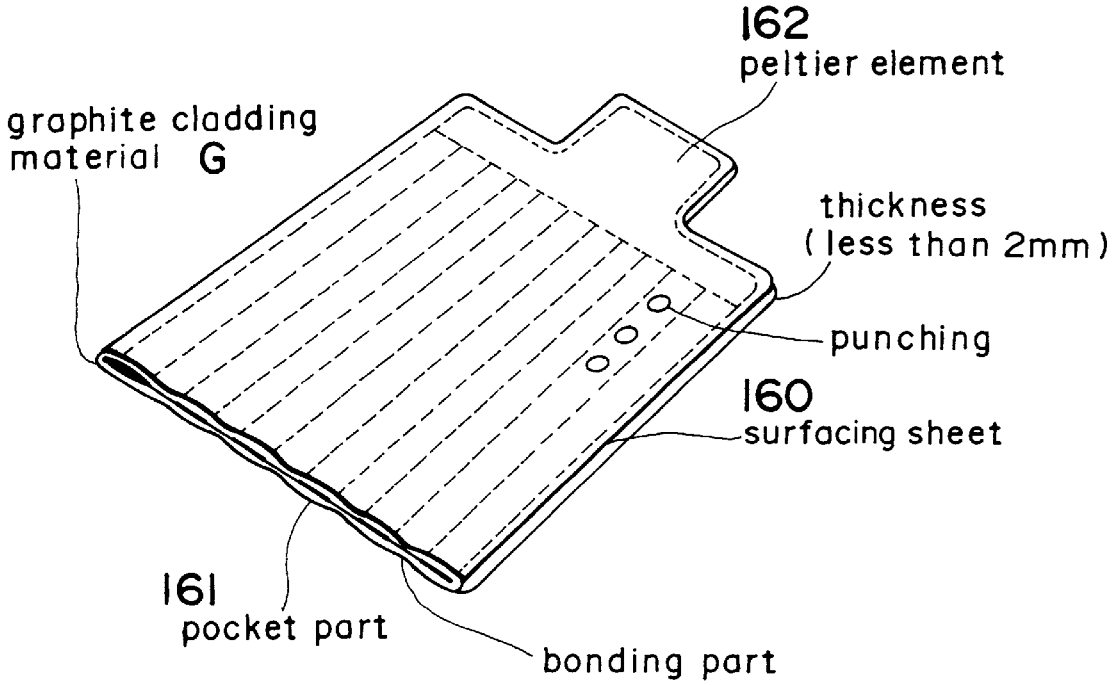
FIG. 27 is a perspective view of a heating device according to Example 18.

FIG. 27 is perspective view in section of a thermal diffusion sheet unit. In this figure, the graphite sheet G having a high orientation is flexible belt-like shape and inserted in a pocket 161 between polymer protective sheets 161 to fit the deformation curvature of the body, and has an end part connected to the Pertie element 162 which is provided at the top of the unit.

Figure 28:
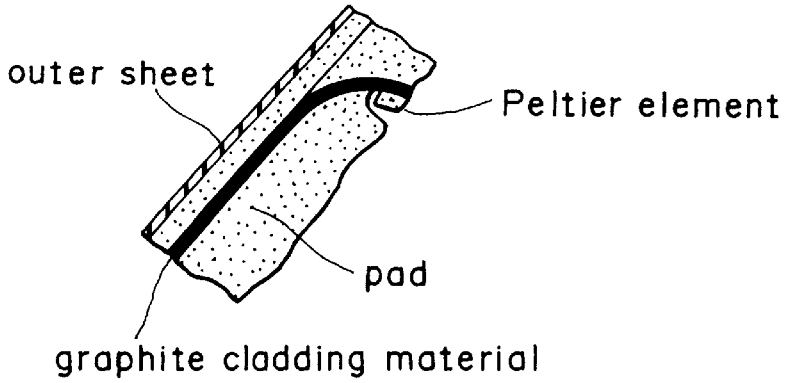
FIG. 28 is a fragmentary view of details of the heating device according to Example 18.

FIG. 28 is a fragmentary view of details illustrating the position of the thermal diffusion sheet unit, shown in FIG. 27, installed in the car seat, relative to the Pertie element.

Conventionally, U.S Pat. No. 3,136,577 described the method of heating the car seat by means of metal plates such as copper. According to the present invention, the graphite sheet having a high orientation is used and therefore, the heat capacity is one-forth and the heat conductivity is two or more times as compared with copper, with the result that a start of heating is five times or more and heating can be performed rapidly and efficiently.

EXAMPLE 19

Figure 29:
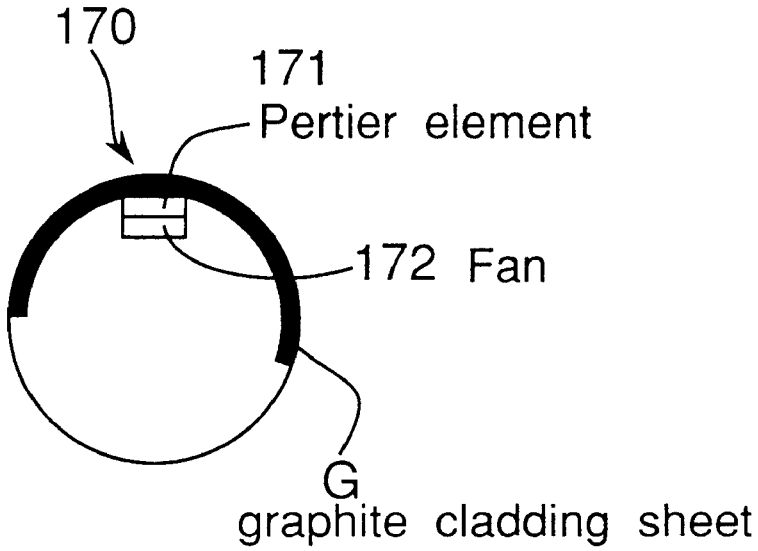
FIG. 29 is a sectional view of a heating device according to Example 19.

FIG. 29 is a sectional view of a circular heat conditioning pillow for cooling and warming which comprises the graphite cladding sheet (or that covered with or sandwiched between said polymer protective sheet or the like) according to the present invention. The graphite sheet G is arranged around the upper half of the pillow inside and a source for cooling and heating, such as a Pertie element 171, is connected to the center of said graphite sheet G. Moreover, there is provided a miniatured fan 172 to diffuse the atmosphere within the pillow.

EXAMPLE 20

Figure 30:
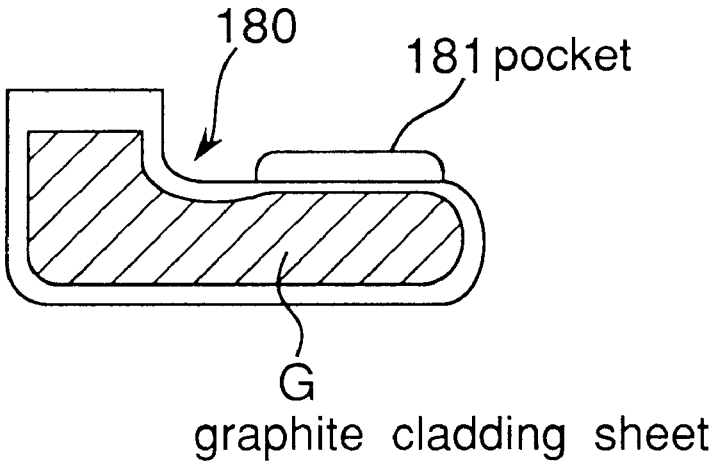
FIG. 30 is a sectional view of a heating device according to Example 20.

FIG. 30 is a sectional view of heat conditioning shoes 180 which comprises the graphite cladding sheet (or that covered with or sandwiched between said polymer protective sheet or the like) according to the present invention. The graphite cladding sheet G is provided on the inner surface of the shoes and a pocket 181 is provided at the upper part of the tip which is connected to the graphite sheet G and receives a source for cooling and heating, in order to cool and warm the whole inside of the shoes.

What is claimed is:

1. A graphite cladding laminate structural material which comprises a flexible graphite sheet made from an aromatic polyimide film having a thickness of 5 to 200 $\mu$m graphitized by baking the same to have a uniformly foamed construction in which benzene rings are oriented in the surface extending direction, wherein the polymer film contains 0.2 to 20 wt. % of fillers which make the film peelable, said flexible graphite sheet having a heat conductivity two times or more than that of Cu in a surface extending direction, and said flexible graphite sheet having Rocking characteristics of less than 20 degrees.

2. The graphite cladding laminate structural material according to claim 1, wherein the flexible graphite sheet has Rocking characteristics of less than 20 degrees.

3. The graphite cladding laminate structural material according to claim 1, wherein the supporting element is a metal sheet.

4. The graphite cladding laminate structural material according to claim 3, wherein the supporting element is a metal lathe plate having recesses and projections or a metal plate having through holes provided with surrounding projection.

5. The graphite cladding structural material according to claim 1, wherein the supporting element is made of the material selected from the group consisting of ceramics, resins, clothes and papers.

6. A device which comprises a heating element made of the graphite cladding laminate structural material according to claim 1.

7. A device which comprises a heating element made of the graphite cladding laminate structural material and a circuit substrate which is laminated on the heating element.

8. A device which comprises a magnetic shielding element made of the graphite cladding laminate structural material according to claim 1.

9. A seat which comprises a heating element made of the graphite cladding laminate material according to claim 1 wherein the graphite sheet of a seat back part and a sheet cushion part are cladded with a skin sheet and a cushion sheet and the graphite sheet is connected to a Pertie element to heat and cool the graphite sheet.

10. The seat according to claim 9, wherein the graphite sheet is a flexible belt shape and inserted in a pocket between polymer protective sheets or a graphite cladding laminate structural material.

11. A heat conditioning pillow for cooling and warming the head, which comprises the graphite sheet provided with high orientation of graphite crystalline according to claim 1 which is arranged around the upper half of the pillow inside and a source for cooling and heating, such as a Pertie element, connected to the graphite sheet.

12. The pillow according to claim 11, wherein the graphite sheet is a flexible belt-like shape and inserted in a pocket between polymer protective sheets or a graphite cladding laminate structural material.

13. Heat conditioning shoes, which comprise the graphite sheet provided with high orientation of graphite crystalline according to claim 1 which is arranged inside and a pocket connected to the graphite sheet for receiving a source for cooling and heating.

14. The shoes according to claim 13, wherein the graphite sheet is a flexible belt-like shape and inserted in a pocket between polymer protective sheets or a graphite cladding laminate structural material.

15. A graphite cladding laminate structural material which comprises a flexible graphite sheet made from an aromatic polyimide film having a thickness of 5 to 200 $\mu$m graphitized by baking the same to have a uniformly foamed construction in which benzene rings are oriented in the surface extending direction, wherein the polymer film contains 0.2 to 20 wt. % of fillers which make the film peelable, said flexible graphite sheet having a heat conductivity two times or more than that of Cu in a surface extending direction, said flexible graphite sheet having Rocking characteristics of less than 20 degrees, and a supporting element or elements which is laminated on at least one surface of the graphite sheet, wherein the flexible graphite sheet and the supporting element or elements are laminated by means of conductive adhesive filled in through holes distributed over the graphite sheet and connected to interlocking elements positioned at a surface opposite to the surface of the graphite sheet at which the supporting element is fixed.

16. A graphite cladding laminate structural material which comprises a graphite crystalline sheet provided with flexibility of Rocking characteristics of less than 20 degrees and a graphite crystalline orientation such that benzene rings constituting the graphite crystalline sheet are oriented in the direction of the surface of the graphite sheet and said graphite crystalline sheet being made from an aromatic polyimide film having a thickness of 5 to 200 $\mu$m graphitized by baking the same to have a uniformly foamed construction in which benzene rings are oriented in the surface extending direction, said graphite crystalline sheet containing 0.2 to 20 wt. % of fillers; and a metal supporting element or elements which is laminated on at least one surface of the graphite sheet, wherein the graphite sheet and the supporting element or elements are fixed by means of conductive adhesive being filled in through holes distributed over the graphite sheet and being connected to interlocking elements positioned at a surface opposite to the surface of the graphite sheet which the supporting element is fixed.

* * * * *